US006170277B1

(12) United States Patent
Porter et al.

(10) Patent No.: US 6,170,277 B1
(45) **Date of Patent: *Jan. 9, 2001**

(54) CONTROL ALGORITHM FOR MAINTENANCE OF DISCHARGE PRESSURE

(75) Inventors: Kevin J. Porter; Garret J. Malone, both of Syracuse; Thomas J. Dobmeier, Baldwinsville, all of NY (US)

(73) Assignee: Carrier Corporation, Syracuse, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/233,775

(22) Filed: Jan. 19, 1999

(51) Int. Cl.[7] ..... F25B 49/00

(52) U.S. Cl. ..... 62/228.3; 62/196.2; 62/196.3; 62/228.5; 62/DIG. 17

(58) Field of Search ..... 62/196.2, 196.3, 62/228.3, 228.5, 196.4, DIG. 17, 160

(56) References Cited

U.S. PATENT DOCUMENTS

| | | | | |
|---|---|---|---|---|
| 2,949,750 | * | 6/1960 | Kramer | 62/196 |
| 2,986,899 | * | 6/1961 | Schenk et al. | 62/196 |
| 3,014,352 | * | 12/1961 | Leimbach | 62/197 |
| 4,193,781 | * | 3/1980 | Vogel et al. | 62/81 |
| 4,330,999 | * | 5/1982 | Nakayama | 62/217 |
| 4,395,203 | * | 7/1983 | Takada | 417/282 |
| 4,507,932 | * | 4/1985 | Suzuki et al. | 62/180 |
| 4,905,477 | * | 3/1990 | Takai | 62/196.3 |
| 5,025,636 | * | 6/1991 | Terauchi | 62/115 |
| 5,140,825 | | 8/1992 | Hanson et al. . | |
| 5,150,581 | * | 9/1992 | Smith | 62/115 |
| 5,168,715 | * | 12/1992 | Nakao et al. | 62/181 |
| 5,172,561 | | 12/1992 | Hanson et al. . | |
| 5,186,014 | * | 2/1993 | Runk | 62/129 |
| 5,289,692 | * | 3/1994 | Campbell et al. | 62/181 |
| 5,291,941 | * | 3/1994 | Enomoto et al. | 165/62 |
| 5,555,744 | * | 9/1996 | Hirano | 62/352 |
| 5,584,186 | * | 12/1996 | Hirano | 62/196.4 |
| 5,806,327 | * | 9/1998 | Lord et al. | 62/115 |
| 5,823,000 | * | 10/1998 | Takai | 62/133 |
| 5,829,264 | * | 11/1998 | Ishigaki et al. | 62/228.3 |
| 5,894,735 | * | 4/1999 | Misawa et al. | 62/177 |
| 5,907,957 | * | 6/1999 | Lee et al. | 62/217 |

* cited by examiner

*Primary Examiner*—Denise L. Ferensic
*Assistant Examiner*—Marc Norman
(74) *Attorney, Agent, or Firm*—Wall Marjama & Bilinski

(57) ABSTRACT

A method is provided for controlling a pressure in a refrigeration system which maintains a pressure within a refrigeration system below a predetermined upper limit, may optionally maintain the pressure above a predetermined lower limit. The pressure being controlled can be a discharge pressure, a suction pressure or the difference therebetween.

35 Claims, 5 Drawing Sheets

CONTROL ALGORITHM FOR MAINTENANCE OF DISCHARGE PRESSURE

FIELD OF INVENTION

The present invention relates to the field of refrigeration systems for heating and cooling in a controlled environment, and in particular to a control algorithm for a refrigeration system which automatically maintains the discharge pressure in the refrigeration system below a predetermined limit.

BACKGROUND OF THE INVENTION

Refrigeration systems are used in many applications for heating and cooling a controlled environment, including a cargo box on a transport truck, train, ship or plane. An important objective of any refrigeration system is to absorb heat by evaporating at low pressure and temperature, and to give up heat by condensing at a higher temperature and pressure. A system's ability to move heat energy in this manner depends primarily on the magnitude of the pressure difference. Consequently, there is a need to establish a large difference in pressure between the high pressure side and the low pressure side of the refrigeration system. To create a large pressure difference it is necessary to establish a high pressure on one side and a low pressure on the other. Unfortunately, the components of a refrigeration system are only designed to withstand certain pressure ratings. If the pressure difference is too great these ratings can be exceeded, then the system components can be damaged. Prior art systems addressed this problem by configuring a control unit to shut a refrigeration system down completely if the system pressures being monitored increased beyond a specified level. As a result, the refrigeration system had to be taken out of service and inspected for problems. Such refrigeration system outages are generally time consuming and costly.

SUMMARY OF THE INVENTION

According to its major aspects and broadly stated, the present invention provides a method of controlling the discharge pressure in a refrigeration system. Steps are provided according to this method for determining if a discharge pressure is below a predetermined upper limit, and adjusting the discharge pressure to bring the discharge pressure below the predetermined upper limit.

According to another aspect of this invention, steps are also provided for determining if a discharge pressure is within a specified pressure range, and adjusting the discharge pressure within the specified pressure range.

According to yet another aspect of the present invention, the above steps of determining and adjusting are continuously repeated.

According to one aspect of the invention, the step of determining if a discharge pressure is within a specified pressure range may be accomplished by determining if the discharge pressure is greater than a predetermined pressure, and determining if the discharge pressure is less than a second predetermined pressure.

According to yet another aspect of the invention, the step of adjusting a valve to increase or decrease the discharge pressure to bring the discharge pressure within the specified pressure range can be implemented by closing a first valve if the discharge pressure is less than said second predetermined pressure until the discharge pressure is within a specified pressure range, and repeating the method if the discharge pressure is greater than the second predetermined pressure.

According to another feature of the present invention, the discharge pressure is lowered if it is too high.

According to yet another feature of the present invention, the processor sends a signal to open condenser pressure control valve if the discharge pressure is too high.

Therefore, it is an object of the present invention to overcome the limitations of the prior art. It is a further object of the present invention to provide a method for maintenance of discharge pressure in a refrigeration system regardless of the ambient temperature conditions to thereby increase the ambient temperature range over which the system is operable.

It is yet a further object of the present invention to provide a control algorithm that maintains adequate, but not excessive discharge pressure in a refrigeration system.

It is a further object of the present invention to signal and alarm when the discharge pressure drifts above or below predetermined limits.

It is yet a further object of the present invention to alert the user of potential problems with a refrigeration system before they adversely affect system performance.

It is a further object of the present invention to selectively open and close a valve to maintain discharge pressure within specified limits.

It is a further object of the present invention to alert the user to the actual problems in the system.

These and other features of the invention, as well as additional objects, advantages, and other novel features of the invention, will become apparent to those skilled in the art upon reading the following detailed description and accompanying drawings.

In order that the present invention may be more readily understood, the following description is given, merely by way of example, reference being made to the accompanying drawings.

DETAILED DESCRIPTION OF THE INVENTION

Figure 1:
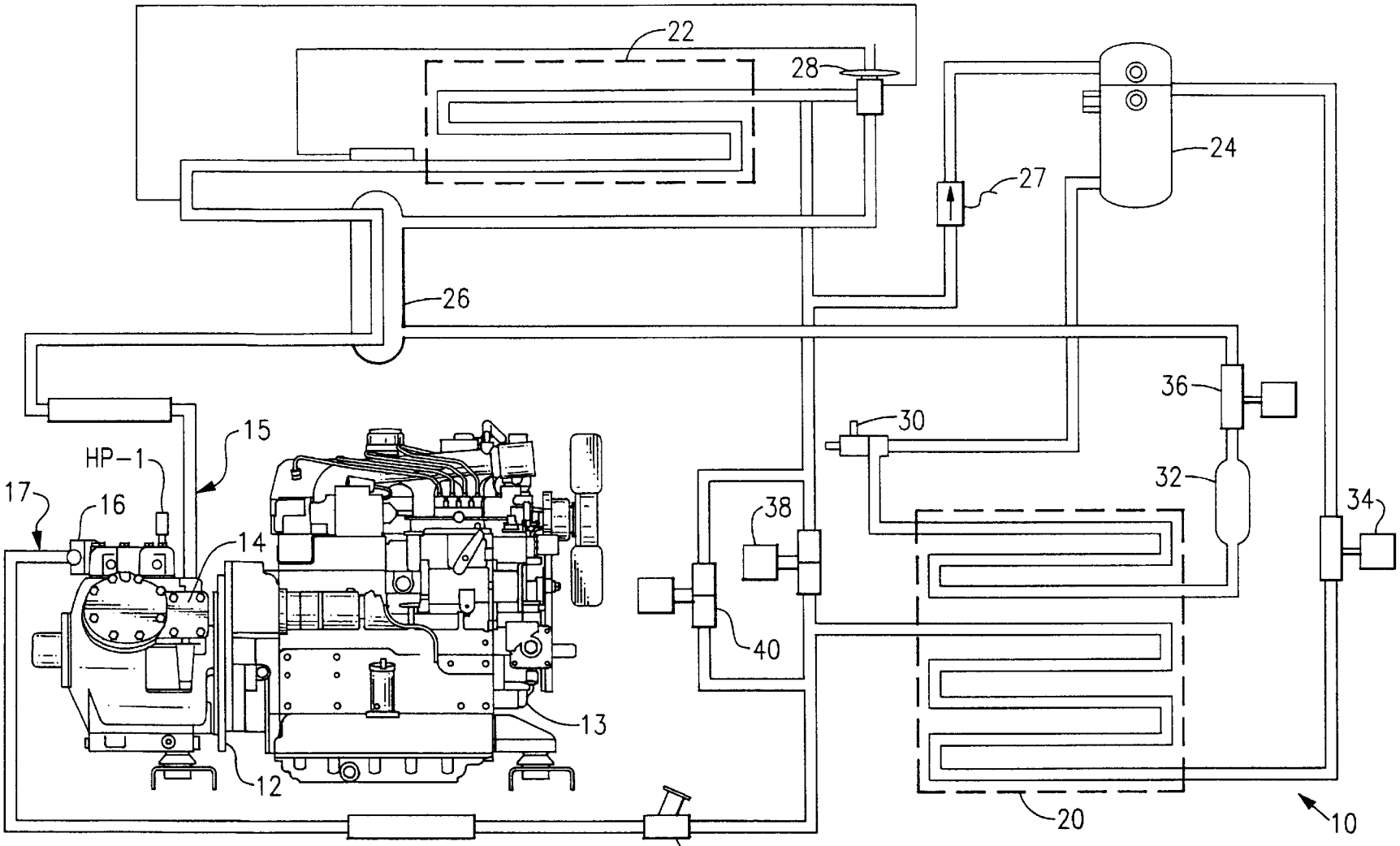
FIG. 1, is a schematic diagram of a refrigeration system.

One particular example of a refrigeration system in which the present invention may be employed is shown in FIG. 1. Refrigeration system 10 includes a compressor 12 driven by an engine 13, a suction service valve 14, a discharge service valve 16, a discharge check valve 18, an air cooled condenser 20 which includes a subcooler portion, an evaporator 22, a receiver 24, a heat exchanger 26, a bypass check valve 27, an expansion valve 28, a manual receiver shutoff valve 30, a filter drier 32, a plurality of valves 34, 36, 38, 40

(typically provided by solenoid valves), a front and rear unloader (not shown), a speed control solenoid 45 (FIG. 2), and an evaporator fan clutch (not shown). Compressor 12 includes a discharge or "high" side 15 and a suction, or "low" side 17. By convention, components of system 10 located toward high side 15 including discharge check valve 18 and condenser 20 are termed "high side" system components whereas system components located toward low side 15 including evaporator 22 and expansion valve 28 are termed "low side" system components. Furthermore, the region of system 10 between discharge side 15 and condenser 20 is conveniently referred to as the "high side" or "high pressure side" of system 10, while the region of system between condenser 20 and suction side 17 is conveniently referred to as the "low side" or "low pressure side" of system 10. Because valves 34–40 all operate to control the flow of refrigerant between high and low side system components, they are sometimes referred to herein as high to low side valves. The refrigeration system 10 operates in various modes, including a cooling mode and a heating/defrost mode. In the cooling mode, the refrigeration system 10 removes heat from a work space. In the heating mode, the refrigeration system 10 adds heat to the work space. In the defrosting mode, the refrigeration system adds energy to the evaporator, where the evaporator fan clutch is off, thus defrosting the evaporator.

Preliminarily, note that any known refrigerant may be used in the system, and that all references made to gas or liquid herein are actually referring to the state of the refrigerant at different places during operation. Generally, the purpose of the refrigerant is to pick up heat by evaporating at low pressure and temperature, and to give up heat by condensing at high temperature and pressure. For instance, by manipulating the pressure of the refrigerant to appropriate levels, the same refrigerant can evaporate at 40 degrees F. and condense at 120 degrees F. By evaporating at a low temperature, heat will flow from the work space into the refrigerant within the direct expansion evaporator 22. Conversely, the refrigerant rejects heat when it condenses from a gas into a liquid. This process is explained in greater detail below.

Operation of the refrigeration system 10 in a cooling mode of operation or a cooling cycle is as follows. In general, during the cooling cycle the evaporator 22 draws heat from the work space being cooled, whereas the condenser 20 is used to reject heat from the high pressure gas to the external environment.

To initiate a cooling cycle, a reciprocating compressor 12 receives low pressure refrigerant in the form of super-heated gas through a suction service valve 14 and compresses the gas to produce a high-pressure, super-heated gas. By reducing the volume of the gas, the compressor 12 establishes a high saturation temperature which enables heat to flow out of the condenser. The high pressure gas is discharged from the compressor 12 through a discharge service valve 16 and flows through a discharge check valve 18 into the condenser 20.

Next, a fan in the condenser 20 circulates surrounding air over the outside of condenser tubes comprising the coil. This coil is where the condensation takes place, and heat is transferred from the refrigerant gas to the air. By cooling the gas as it passes through the condenser 20, the removal of heat causes the gas to change state into a high-pressure saturated liquid. The refrigerant leaves the condenser as a high-pressure saturated liquid, and flows through valve 34, conveniently referred to as "condenser valve", into the receiver 24. As is shown in FIG. 1, valves 38 and 40, conveniently referred to as "hot gas valves", are closed thereby keeping the discharged gas from entering into a direct expansion evaporator 22.

From the air-cooled condenser 20, the high-pressure liquid then passes through open condenser valve 34 (sometimes referred to herein as condenser pressure control valve 34) and into a receiver 24. The receiver 24 stores the additional charge necessary for low ambient operation in a heating mode. The receiver 24 is equipped with a fusible plug which melts if the refrigerant temperature is abnormally high and releases the refrigerant charge. At the receiver 24, any gas remaining in the high-pressure liquid is separated and the liquid refrigerant then passes back through the manual receiver shutoff valve 30 (king valve) and into a subcooler section of the condenser 20 where it is subcooled. The subcooler occupies a portion of the main condensing coil surface and gives off further heat to the passing air. After being subcooled the liquid then flows through the filter-drier 32 where an absorbent keeps the refrigerant clean and dry. The high-pressure liquid then passes through the electrically controlled valve 36, conveniently referred to as "liquid line valve", which starts or stops the flow of refrigerant. In addition, the high-pressure liquid may flow to a heat exchanger 26. If so, the liquid is cooled even further by giving off some of its heat to the suction gas.

Next, the cooled liquid emerging from the heat exchanger 26 passes through an externally equalized thermostatic expansion valve 28. As the liquid is metered through the valve 28, the pressure of the liquid drops, thus allowing maximum use of the evaporator heat transfer surface. More specifically, this expansion valve 28 takes the subcooled liquid, and drops the pressure and temperature of the liquid to regulate flow to the direct expansion evaporator 22. This results in a low pressure saturated liquid/gas mixture.

After passing through the expansion valve 28, the liquid enters the direct expansion evaporator 22 and draws heat from the work space being cooled. The low pressure, low temperature fluid that flows into the evaporator tubes is colder than the air that is circulated over the evaporator tubes by the evaporator fan. As a result, heat is removed from the air circulated over the evaporator 22. That is, heat from the work space is transferred to the low pressure liquid thereby causing the liquid to vaporize into a low-pressure gas, thus, and the heat content of the air flowing over the evaporator 22 is reduced. Thus, the work space experiences a net cooling effect, as colder air is circulated throughout the work space to maintain the desired temperature. Optionally, the low-pressure gas may pass through the "suction line/liquid line" heat exchanger 26 where it absorbs even more heat from the high pressure/high temperature liquid and then returns to the compressor 12.

After passing through the heat exchanger 26, the gas enters the compressor 12 through the suction service valve 14 where the process repeats itself. That is, the air cooled by the evaporator 22 is sent directly to the air conditioned work space to absorb more heat and to bring it back to the coil for further cooling.

The refrigeration system of the present invention may also be used to heat the work space or defrost the evaporator 22. During the heating/defrost cycle, a low pressure vapor is compressed into a high pressure vapor, by transferring mechanical energy from a reciprocating compressor 12 to the gas refrigerant as it is being compressed. This energy is referred to as the "heat of compression", and is used as the source of heat during the heating/defrost cycle. This refrigeration system is known as a "hot gas heat" type refrigeration system since the hot gas from the compressor is used as the heat source for the evaporator. By contrast, the present invention could also be employed with heat pumps wherein the cycle is reversed such that the heat normally rejected to the ambient air is rejected into the work space. The heating/defrost cycle will now be described in detail.

In the heating/defrost cycle, the reciprocating compressor 12 receives low pressure and low temperature gas through the suction service valve 14 and compresses the gas to produce a high pressure gas. The high temperature, high pressure gas is discharged from the compressor 12 through the discharge service valve 16. The hot gas valve 38 and the condenser pressure valve 34 are closed to prevent refrigerant from flowing through them. This closes off the condenser 20 so that once the condenser coils are substantially filled with refrigerant, the majority of the refrigerant will then flow through the discharge check valve 18 and the hot gas valve 40. The hot gas from the compressor 12 then flows into the evaporator 22, effectively transferring energy from the compressor to the evaporator and then to the work space.

A processor 100 opens valve 36 when the compressor discharge pressure falls to cut-in settings, allowing refrigerant from the receiver to enter the evaporator 22 through the expansion valve 28. The hot vapor flowing through valve 40 forces the liquid from the receiver 24 via a bypass check line and a bypass check valve 27. By opening valve 36 and closing valve 34, the refrigerant liquid is allowed to fill up and build up head pressure, equivalent to discharge pressure, in the condenser 20. Opening valve 36 also allows additional refrigerant to be metered through the expansion valve 28 so that it eventually is disposed in the condenser 20. The increase of the refrigerant in the condenser 20 causes the discharge pressure to rise, thereby increasing the heating capacity of the refrigeration system 10. This allows the compressor 12 to raise its suction pressure, which allows the refrigeration system 10 to heat. Liquid line valve 36 will remain open until the compressor discharge pressure increases to cut-out setting, at which point a processor 100 closes (shown in FIG. 2) solenoid valve 36. This stops the flow of refrigerant in the receiver 24 to the expansion valve 28. Significantly, valve 36 may be closed only after the compressor 12 is discharging at a cut-out pressure. Thus, via the evaporator 22, the high pressure refrigerant gas gives off heat to the work space, lowering the temperature of the refrigerant gas. The refrigerant gas then leaves the evaporator 22 and flows back to the compressor 12 through the suction service valve 14.

In a preferred embodiment, the hot gas valve 38 is closed if the ambient temperature is above a first predetermined temperature. If after a 60 second delay the engine remains in high speed, and the difference between ambient and discharge temperatures exceeds a pre-determined temperature differential, then valve 38 opens. On the other hand, if the difference between ambient and discharge temperatures goes below a second pre-determined temperature differential, then valve 38 closes. When in engine operation and the discharge pressure exceeds predetermined pressure settings, pressure cutout switch (HP-1) opens to de-energize the run relay coil and stop the engine.

Figure 2:
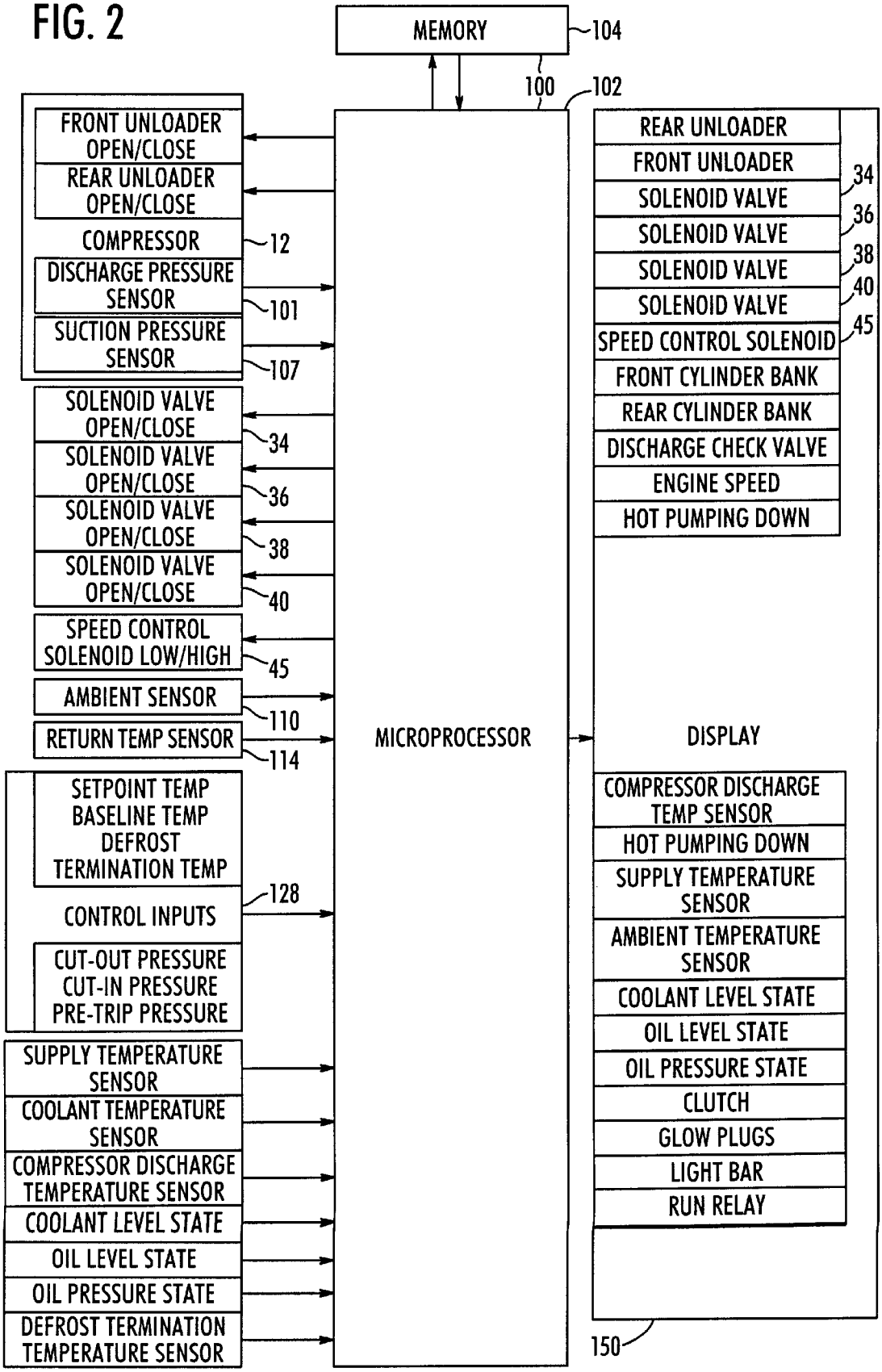
FIG. 2, is a block diagram showing a processor for interfacing with various components of the refrigeration system of FIGS. 1 and 2.

Turning to FIG. 2, the refrigeration system 10 is electronically controlled by a control unit shown as being provided by a processor 100, including a microprocessor 102 and an associated memory 104. The processor 100 is connected to a display 150 which displays various parameters and also various fault alarms that exist within the refrigeration system 10.

When the refrigeration system 10 is in an operating mode to control the temperature of a work space, the processor 100 receives several inputs including an ambient temperature from an ambient temperature sensor 110, a setpoint temperature, a return temperature from a return temperature sensor 114, a baseline temperature, a suction pressure from a suction pressure transducer 107, a discharge pressure from a discharge pressure transducer 101, a cut-out pressure, a cut-in pressure and a pretrip pressure. The ambient temperature is received by the processor 100 through the ambient temperature sensor 110 on the exterior of the work space. The setpoint temperature is input to the processor 100 through an input control device 128 and is typically the desired temperature of the work space. The return temperature is the actual temperature of the work space and is received by the processor 100 through the return temperature sensor 114 located within the work space. The baseline temperature is input to the processor 100 through the input control device 128 and will be discussed later.

In addition, there are several other inputs to the processor 100 including a supply temperature, a coolant temperature, a compressor discharge temperature, a coolant level state, an oil level state, an oil pressure state, and a defrost termination temperature.

The suction pressure, sensed by the suction pressure transducer 107, is the pressure of the refrigerant vapor at the low side of the compressor 12 as it is being drawn into the compressor through the suction service valve 14. The suction pressure transducer 107 is disposed in a position to monitor the pressure through the suction service valve 14 and the suction pressure value is input to the processor 100, where the processor 100 uses the value or stores the value for later use.

The discharge pressure, sensed by the discharge pressure transducer 101, is the pressure at the high side of the compressor 12. This is the pressure of the refrigerant vapor as it is being discharged from the compressor 12 through the discharge service valve 16. The discharge pressure is monitored by a pressure transducer 101 disposed in a position to monitor the pressure through the discharge service valve 16 and the discharge pressure value is input to the processor 100, where the processor 100 uses the value or stores the value for later use.

At certain times during operation of refrigeration system 10 in an operational mode, such as a cooling, a heat/defrost mode, or a pretrip mode, it may be necessary to control an input to a system component based on a pressure differential indicator which indicates a pressure differential between different points in a refrigeration system such as between a high side and a low side of compressor 12. Because discharge pressure, suction pressure, and pressure differential normally predictably depend on one another, this pressure differential indicator can in general, be provided by any one of a discharge pressure reading, a suction pressure reading or pressure differential such as (discharge pressure minus suction pressure) reading or by a combination of such readings. Furthermore, because pressure is related to temperature, a pressure differential indicator can also normally be provided by a discharge temperature reading, a suction temperature reading, or temperature differential such as (discharge temperature minus suction air temperature) reading or by a combination of such readings. Under certain circumstances, however, such as where the refrigerant is subjected to temperature sensing in a vapor-only phase, a temperature transducer may not provide as reliable an indicator as pressure as a pressure transducer.

The cut-out pressure, cut-in pressure and pretrip pressure are user selected pressure values that are input to the processor 100 through the input control device 128 and will be discussed below.

The processor 100 determines whether to operate refrigeration system 10 in a cooling mode or heating mode by comparing the setpoint temperature to the supply and/or return temperature. If the setpoint temperature is less than the return temperature, then processor 100 operates the refrigeration system 10 in a cooling mode. If the setpoint temperature is greater than the return temperature, then processor 100 operates refrigeration system 10 in a heating mode.

In the cooling mode, the processor 100 opens and closes high-to-low side valves 34–40 according to a required protocol as described previously herein in connection with FIG. 1. In particular, the processor 100 opens valves 34 and 36 and closes valves 38 and 40, which forces the refrigerant to flow from the compressor 12 to the condenser 20, through the condenser 20 and to the receiver 24, through the receiver 24 and back to the condenser 20, through the condenser 20 and to the heat exchanger 26, through the heat exchanger 26 and through the expansion valve 28 and then to the evaporator 22, through the evaporator 22 and back through the heat exchanger 26, and then back to the compressor 12. The details of the cooling mode have been discussed above.

In the heating mode, the processor 100 opens and closes high-to-low side valves 34–40 according to a required protocol and as described previously according to FIG. 1. In particular, the processor 100 closes condenser valve 34 and opens hot gas valve 40, which causes the condenser 20 to fill with refrigerant, and forces the hot gas from the compressor 12 into the evaporator 22. The liquid line valve 36 remains open until the discharge pressure reaches the cut-out pressure, at which point the processor 100 de-energizes and closes the liquid line valve 36 thereby stopping the flow of refrigerant into the expansion valve 28. When the compressor discharge pressure falls to the cut-in pressure, the processor 100 in turn energizes the closed liquid line valve 36 which opens, allowing refrigerant from the receiver 24 to enter the evaporator 22 through the expansion valve 28. Typically, in the heating mode, valve 38 remains closed until the compressor discharge temperature rises by a predetermined amount at which point valve 38 opens. The details of the heating mode have been discussed above. From time to time, the refrigeration system 10 will be caused to cease operating in a cooling or heating/defrost mode. For example, refrigeration system 10 is employed to control the air temperature of a tractor trailer work space (known as a "box") it is typical to take the refrigeration system 10 out of a cooling or heating/defrost mode when a door of the trailer is opened for loading or unloading goods from the box. Before starting up the refrigeration system 10, or restarting the system 10 after a temporary shutdown, it is sometimes desirable to have the processor 100 execute a routine in order to determine the operational condition of various components of the refrigeration system 10. Because such a routine is useful in determining component problems which may cause the refrigeration system 10 to malfunction when placed on-line (that is, caused to operate in a cooling or heat/defrost mode), such a routine may be referred to as a "pretrip" routine.

Preferably, the pre-trip routine comprises several tests for determining the mechanical operation of each of several system components such as high-to-low side valves 34, 36, 38, 40, the discharge check valve 18, a front unloader, a rear unloader, a front cylinder bank and a rear cylinder bank (not shown) of the compressor 12.

Methods for administering pretrip routines for testing of refrigeration systems are discussed in Application Serial No. (not assigned), filed concurrently herewith, entitled "Adaptive Pretrip Selection" and Application Serial No. (not assigned), filed concurrently herewith, entitled "Pretrip Routine Comprising Tests of Individual Refrigeration System Components", each of which are assigned to the assignee of the present invention, and incorporated herein by references in their entirety. "A Method for Conducting a Test of a Refrigeration System Compressor" is described in Application Serial No. (not assigned), filed concurrently herewith, entitled "Pretrip Device for Testing of a Refrigeration System Compressor", also filed concurrently herewith, and assigned to the assignee of the present invention and incorporated herein by references in its entirety.

Now referring to particular aspects of the present invention, the present invention relates to a method for controlling discharge pressure in a refrigeration system to enhance operation of refrigeration system in any one of a cooling mode, a heating/defrost mode or a pretrip mode of operation. Controlling discharge pressure ensures that the discharge pressure does not increase beyond a pressure which would result in the compressor 12 being shut off or which would cause damage to system components.

As skilled artisans will recognize, discharge pressure, suction pressure, and differential pressure are all dependent upon each other and all vary predictably with respect to one another. Accordingly, while the present invention is described as a method for controlling discharge pressure, it should be apparent that the invention also provides a method for controlling differential pressure (discharge pressure minus suction pressure) and suction pressure.

While the discharge pressure control method of the present invention may be employed in cooling or heating/defrost mode, it is especially useful, as will be explained herein, to employ the invention in a pretrip routine during the course of conducting leak tests of system components. "Methods for Administering Leak Tests" are discussed in Application Serial No. (not assigned), filed concurrently herewith entitled "Automated Detection of Leaks in A Discharge Check Valve" and Application Serial No. (not assigned), filed concurrently herewith entitled "Test for the Automated Detection of Leaks Between High and Low Pressure Sides of a Refrigeration System", each of which are assigned to the assignee of the present invention, and incorporated herein by reference in their entirety.

Figure 3:
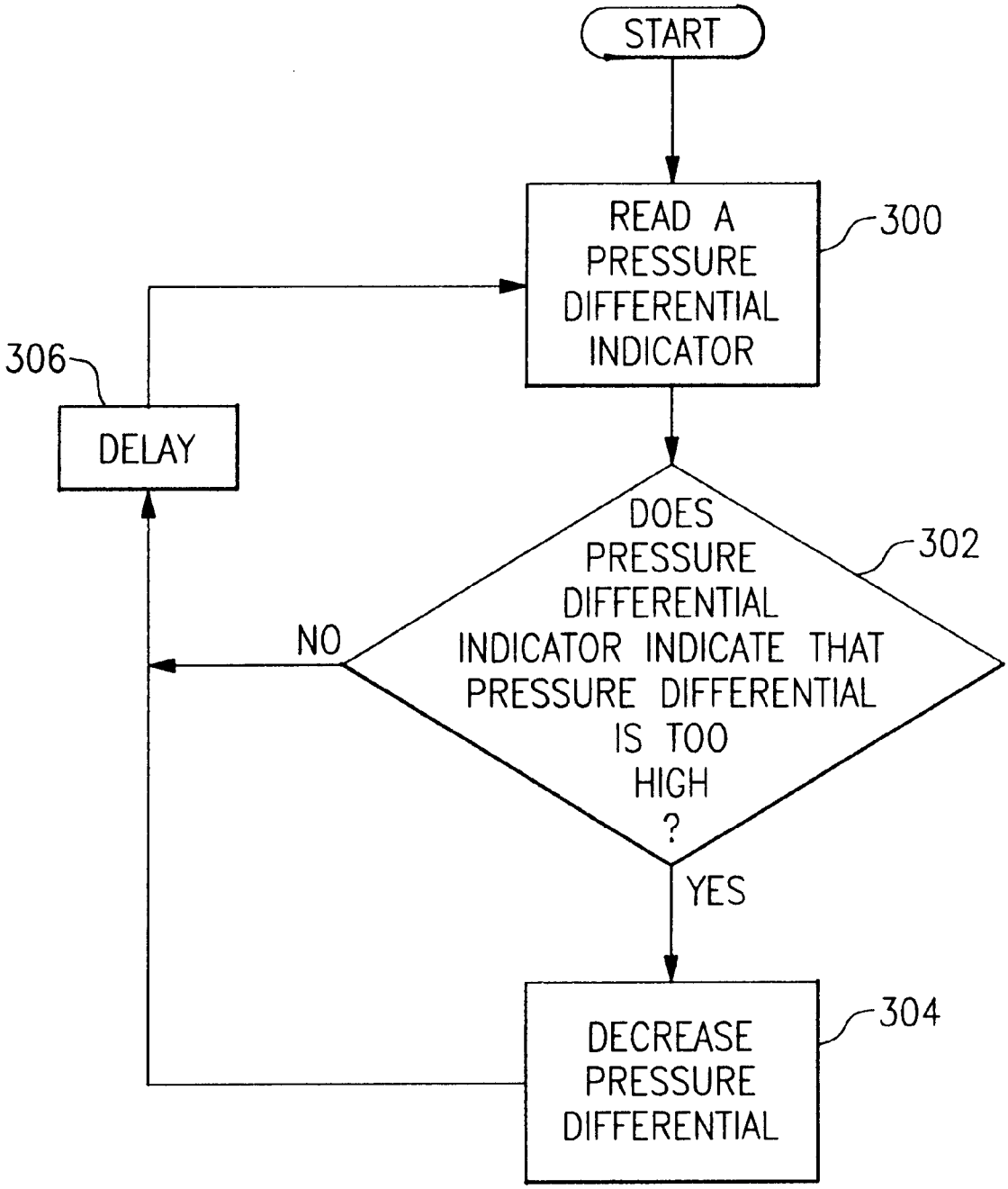
FIG. 3, is a flow diagram of a program which maintains discharge pressure below a predetermined upper limit by decreasing the discharge pressure if it increase past a predetermined limit, according to the present invention.

A flow diagram illustrating operation of a discharge pressure control method according to the invention is described with reference to FIG. 3. In accordance with the method, processor 100 at block 300 reads a pressure differential indicator (such as a discharge pressure, a suction pressure, or pressure differential reading) and determines at block 302 whether the pressure differential indicator indicates that a pressure differential has exceeded a predetermined pressure. If processor 100 determines at block 302 that differential pressure has exceeded a predetermined pressure then processor 100 at block 304 reduces the pressure differential and proceeds again to block 300 to read another pressure differential indicator after executing an optional delay, indicated by block 306 which will be explained in greater detail hereinbelow.

Processor 100, through appropriate control of various system components, may decrease the pressure differential at block 304 in a number of different ways. 40. Any known means may be used to increase or decrease the discharge pressure. For example, processor 100 may decrease the pressure by reducing the capacity of compressor 12 or turning the compressor 12 off completely. The capacity of the compressor may be reduced by unloading cylinder banks of the compressor, thereby reducing the compressor's ability to compress vapor. In the alternative, the processor may reduce the pressure differential of the system at block 304 by opening any one of the systems high to low side valves including the condenser pressure control valve 34, liquid solenoid valve 36, and the hot gas solenoid valves 38 and 40. Thus, if the pressure is too high, it can be decreased to bring it below a predetermined upper limit. If it is desired to increase pressure differential, pressure can be increased by selectively increasing the capacity of the compressor for a given period of time. The discharge pressure could also be increased by closing a high-to-low side valve while keeping the compressor speed constant. Therefore, either method could be used to increase the pressure above a predetermined lower limit.

While the differential pressure control method may be implemented in any one of a cooling, heating/defrost, or a pretrip mode, particular aspects relating to how the preferred method is carried out will vary depending on which mode the refrigeration unit operates in.

For example, during a cooling mode of operation, discharge pressure control can be used to ensure that the discharge pressure does not exceed the mechanical safety limits of the unit. The discharge pressure can be controlled by adjusting the capacity of the compressor. However, the discharge pressure normally can not be controlled by opening and closing the condenser pressure control valve 34 since this valve is generally required to remain open throughout the entire cooling process.

Similarly, during the heating mode of operation, the discharge pressure control is useful to prevent excessively high discharge pressures which occur during high ambient temperatures. During the heating mode of operation, the condenser pressure control valve 34 is closed to increase discharge pressure. However, when the ambient temperature is high, the already high discharge pressure will increase even further due to the closing of condenser pressure control valve 34. As a result, the discharge pressure will increase dramatically. This excessive discharge pressure will cause a pressure control sensor to trip, and the processor 100 will turn off the compressor in order to avoid mechanical damage to the unit. Thus, by implementing the present invention, the discharge pressure may be accurately controlled. This allows for great increases in the ambient temperature range in which units can heat and defrost, while preventing the unit from shutting down.

This discharge pressure control is also particularly useful any time there is a risk of excessive discharge pressure. A pretrip mode of operation may implement a process known as "pump down", in which the high pressure side and low pressure side are isolated from each other, and the compressor pressure is increased to substantially increase the discharge pressure. Thus, the method according to the present invention is particularly useful during a pretrip mode of operation, in which a refrigeration system is subjected to the pump down process.

Moreover, during the pump down phase of the pretrip mode of operation it is necessary to maintain the discharge pressure at very high levels. Therefore, it is also necessary to place a lower limit on the minimum discharge pressure. In other words, it is also beneficial to control the range of discharge pressures in which the system is allowed to operate.

Figure 4:
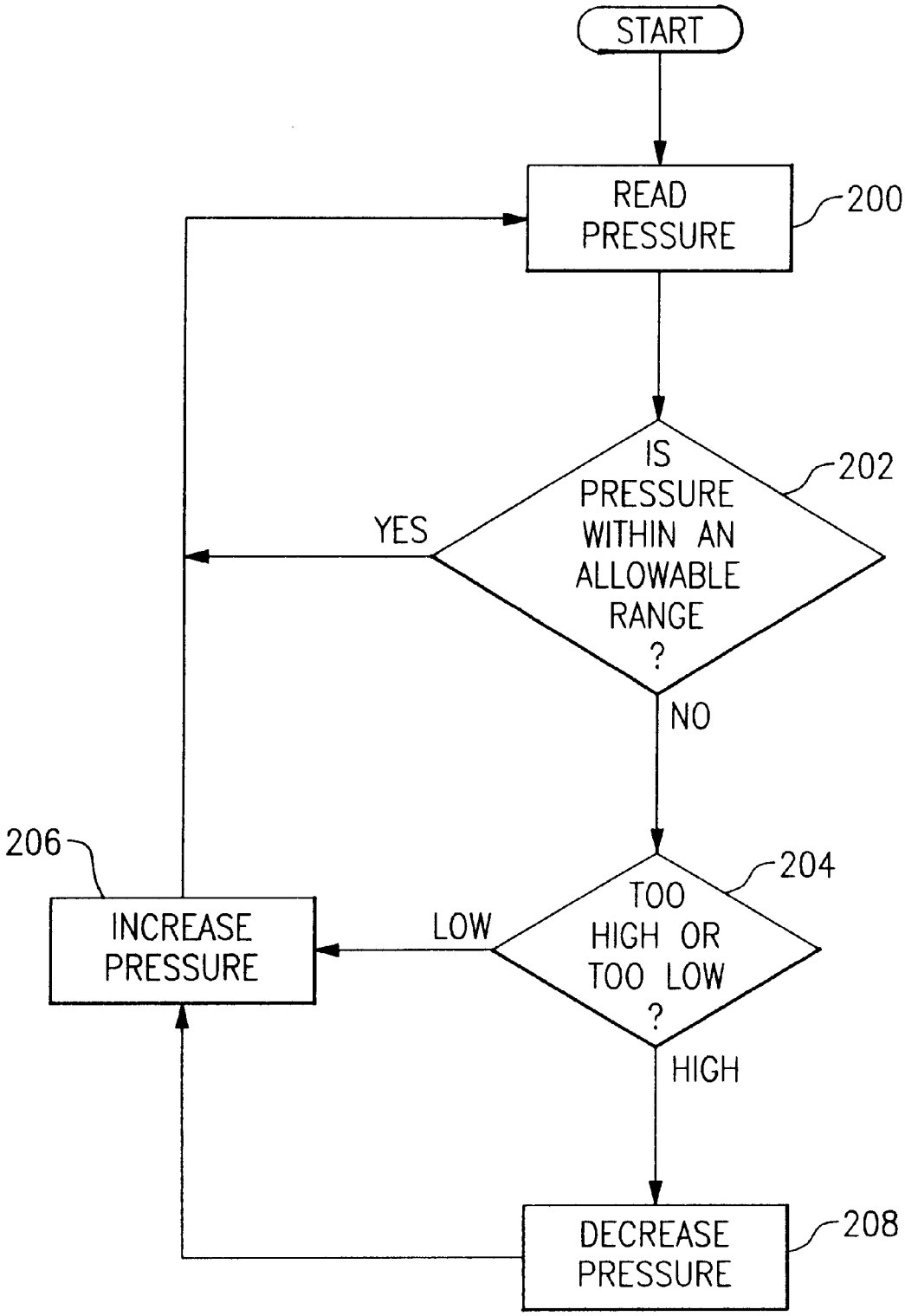
FIG. 4, is a flow diagram of a program which maintains discharge pressure within a specified range by selectively increasing and decreasing the discharge pressure, according to the present invention.

Consequently, in a second embodiment of the present invention, this discharge pressure control method may be modified to maintain discharge pressure within a preset range. The pressure is maintained by selectively increasing or decreasing the discharge pressure in response to pressure or temperature changes at different points in the system. The range of pressures can be as wide as the physical limits of the system will allow. FIG. 4 shows a flow chart depicting the various steps that a processor may execute to maintain discharge pressure within a specific range.

As indicated by step 200 of FIG. 4, the processor 100 first determines the pressure, and then at block 202 determines if this pressure is within an allowable range. If it is within the range, then the processor 100 re-executes the method of discharge pressure control at block 202. However, if at step 202, the processor 100 determines that the discharge pressure is not within the allowable range, then the processor 100 determines at block 204 whether the pressure is too high or too low. To determine this, as indicated at block 204, the processor 100 determines whether the pressure is greater than a first predetermined discharge pressure (preferably about 385 psig). As indicated by block 208, if the processor determines at block 204 that the pressure is above an upper limit discharge pressure, then the processor lowers discharge pressure (preferably by opening the condenser valve 34). By contrast, as indicated by block 206, if the processor 100 determines at block 204 that the pressure is below a lower limit discharge pressure, then the processor 100 increases the discharge pressure (preferably by closing the condenser valve 34). In the preferred embodiment, closing condenser valve 34 allows the discharge pressure to build relatively high, which creates a large pressure differential across the valves connecting the high pressure side to the low pressure side. The pressure is continually increased or decreased to maintain the discharge pressure within the desired range. Once the target discharge pressure is reached, the processor 100 re-executes the discharge pressure control method from the beginning at block 200, and continues to run to ensure that the discharge pressure remains between the first predetermined discharge pressure and the second, lower predetermined discharge pressure. Thus, in the preferred embodiment, the discharge pressure control continually commands condenser pressure control valve to open and close to maintain the discharge pressure between 375 and 385 psig.

As shown in blocks 204 and 208, if the discharge pressure is greater than a predetermined discharge pressure (preferably 385 psig), and the condenser pressure control valve 34 has already opened in the previous implementation of the discharge pressure control, then the processor 100 closes condenser valve 34, and re-executes the algorithm from the beginning. If the discharge pressure is below the first predetermined pressure, then the condenser valve 34 must be closed to increase discharge pressure since an open condenser valve 34 will cause the discharge pressure to drop.

If the condenser valve is used to control pressure, it may be advantageous to limit the time that the condenser pressure control valve 34 is opened under certain conditions, especially when discharge pressures become excessive. For example, during the pump down phase of leak testing, discharge pressures commonly exceeds 350 psig. The greater the difference is between suction pressure and discharge pressure, the more quickly the discharge pressure will drop when the condenser pressure control valve 34 is opened. Accordingly, when extremely high discharge pressures are expected, it is preferred that the time duration in which the condenser valve is opened is limited (preferably, to 1 second). This allows the discharge pressure to be decreased, while guarding against excessive drops in discharge pressure.

Excessive discharge pressures are expected only under certain operating conditions. For example, during the heating and defrost modes of operation the discharge pressure is relatively high. Consequently, the drop across the condenser pressure control valve 34 is relatively high. In the cooling mode, the drop across the valve is not a factor since the condenser pressure control valve 34 remains opened during cooling. During a cool pretrip, the pressure difference across the condenser pressure control valve 34 is relatively small despite the high discharge pressure. As a result, the condenser pressure control valve 34 can be opened for a relatively long time period without a significant drop in the discharge pressure. By contrast, in a heat pretrip mode of operation, the discharge pressure is very high, while the receiver pressure is relatively low. This creates a larger pressure drop across the valve, which causes a significant pressure drop as a substantial amount of refrigerant squirts from the condenser into the receiver when the condenser pressure control valve 34 is opened. Consequently, there is a time limit on how long the condenser pressure control valve 34 can be opened.

Figure 5:
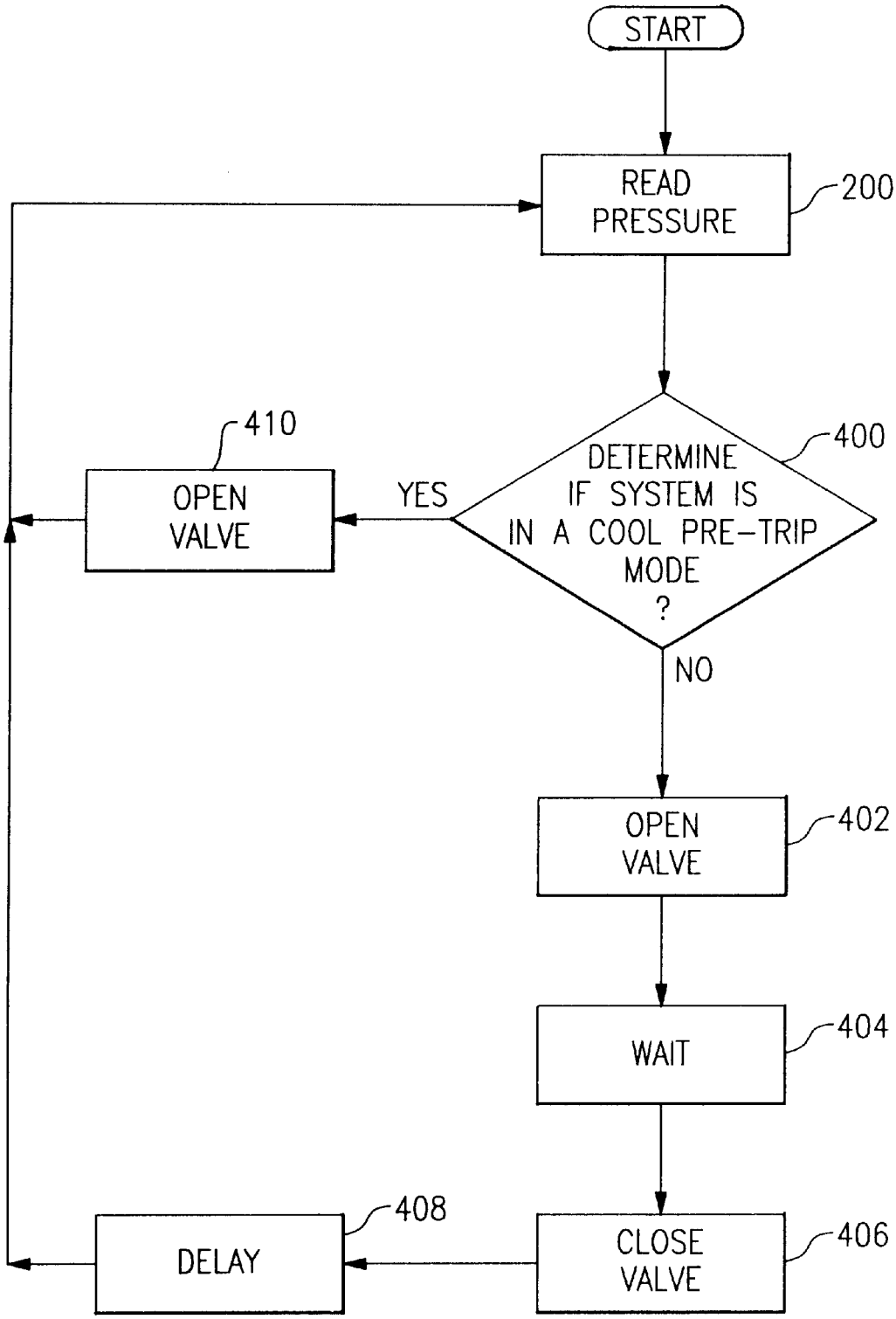
FIG. 5, is a flow diagram of a program which decreases discharge pressure to maintain discharge pressure within a specified range, according to the present invention.

With reference to FIG. 4, if the discharge pressure is greater than the first predetermined pressure, and condenser pressure control valve 34 has not already been opened, then at step 208 the processor 100 opens condenser pressure control valve 34. The duration for which the valve will open depends upon whether a cool pretrip is being implemented or if the system is in another mode of operation, such as heating/defrost mode or heat pretrip. The process by which pressure is decreased in block 208, is further described with reference to FIG. 5.

To reduce the discharge pressure during a non-cooling mode situation, the processor 100 sends a signal to open condenser pressure control valve 34 for a short time (preferably one second), and then closes the condenser pressure control valve 34 as indicated by steps 402 and 406. The condenser pressure control valve 34 is preferably opened for only one second since opening the valve 34 for more than one second would allow too much refrigerant to squirt from the condenser 12 into the receiver 18, and the discharge pressure would drop too much. Next, as shown in block 408, the processor 100 waits a predetermined time (preferably 5 seconds) to allow the discharge pressure within the system to stabilize. The processor 100 then re-executes from the beginning.

On the other hand, if at block 400, it is determined that the unit is running a cool pretrip, then the processor 100 opens condenser pressure control valve 34 and high-to-low side valve 36, while simultaneously closing high-to-low side valves 38 and 40. The processor 100 then unloads the compressor's 12 front and rear cylinder banks. This allows the compressor to run on low speed. With only one cylinder bank producing compressed refrigerant gas, the head pressure in the condenser 20 builds up slowly. Therefore, if at block 400, it is determined that the unit is running in a cool pretrip, then the processor 100 opens condenser pressure control valve 34, as indicated at block 410. Thus, the pressure difference is decreased by allowing the refrigerant to slowly flow from the condenser 12 into the receiver 24, and no one second limitation is necessary on the time condenser pressure control valve 34 is opened. The discharge pressure control then re-executes from the beginning.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A method for controlling pressure in a refrigeration system, said method comprising the steps of:

(a) reading a pressure differential indicator;

(b) determining whether said pressure differential indicator indicates that a pressure differential has exceeded a predetermined pressure;

(c) repeating steps (a) and (b);

(d) reducing said pressure differential if said pressure differential indicator indicates that said pressure differential has exceeded said predetermined pressure; and (e) executing a delay subsequent to execution of said reducing step in order to allow said pressure within said refrigeration system to stabilize.

2. The method of claim 1, wherein said reducing step includes the step of opening a valve for a limited time to prevent excessive drops in pressure.

3. The method of claim 2, wherein said reducing step includes the step of opening a condenser pressure control valve.

4. The method of claim 2, wherein said reducing step includes the step of opening a high-to-low-side valve.

5. The method of claim 1, wherein said reducing step includes the step of opening a condenser pressure control valve.

6. The method of claim 1, wherein said reducing step includes the step of opening a high-to-low-side valve.

7. The method of claim 1, wherein said reducing step includes the step of reducing a capacity of a compressor of said refrigeration system.

8. The method of claim 1, wherein said delay of step (e) is about 5 seconds.

9. A method for controlling pressure in a refrigeration system, said method comprising the steps of:

reading a pressure differential indicator; and changing said pressure differential in response to said pressure differential indicator by adjusting a high-to-low-side valve.

10. The method of claim 9, wherein said changing step includes the step of closing said high-to-low-side valve to increase said pressure differential if said pressure differential indicator indicates that said pressure differential has fallen below a predetermined lower limit.

11. The method of claim 9, wherein said changing step includes the step of opening said high-to-low-side valve to decrease said pressure differential if said pressure differential indicator indicates, that said pressure differential is above a predetermined upper limit.

12. A method for controlling pressure in a refrigeration system, said method comprising the steps of:

reading a pressure differential indicator; and changing said pressure differential in response to said pressure differential reading by adjusting a condenser pressure control valve.

13. The method of claim 12, wherein said changing step includes the step of closing said high-to-low-side valve to increase said pressure differential if said pressure differential indicator indicates that said pressure differential is below a predetermined lower limit.

14. The method of claim 12, wherein said changing step includes the step of opening said high-to-low-side valve to decrease said pressure differential if said pressure differential indicator indicates that said pressure differential is above a predetermined upper limit.

15. A method for operating a refrigeration system, said method comprising the steps of:

executing a heating mode of operation; and while executing said heating mode, controlling a discharge pressure of said system by adjusting a condenser pressure control valve.

16. The method of claim 15, wherein said adjusting step includes the step of closing said high-to-low-side valve to increase said pressure differential if said pressure differential indicator indicates that said pressure differential is below a predetermined lower limit.

17. The method of claim 15, wherein said adjusting step includes the step of opening said high to low side valve to decrease said pressure differential if said pressure differential indicator indicates that said pressure differential has risen above a predetermined upper limit.

18. A method for operating a refrigeration system, said method comprising the steps of:

executing a heating mode of operation;

while executing said heading mode, reading a discharge pressure differential indicator; and changing said discharge pressure of said system in response to said discharge pressure differential reading.

19. The method of claim 18, wherein said changing step includes the step of reducing said discharge pressure if said discharge pressure exceeds a predetermined upper limit.

20. The method of claim 18, wherein said changing step includes the step of increasing said discharge pressure if said discharge pressure is below a predetermined lower limit.

21. The method of claim 18, wherein said changing step includes the step of adjusting a valve of said system selected from the group consisting of a high-to-low-side valve and a condenser valve.

22. The method of claim 18, wherein said changing step includes the step of adjusting a capacity of a compressor of said refrigeration system.

23. A method for controlling pressure in a refrigeration system, said method comprising the steps of:

reading a discharge pressure differential indicator; and increasing said discharge pressure if said discharge pressure differential indicator indicates that said discharge pressure has decreased below a predetermined lower limit.

24. The method of claim 23, wherein said increasing step includes the step of closing a valve of said system selected from the group consisting of a high-to-low-side valve and a condenser valve.

25. The method of claim 23, herein said increasing step includes the step of increasing a capacity of a compressor of said refrigeration system.

26. A method for controlling discharge pressure in a refrigeration system, said method comprising the steps of:

reading a discharge pressure indicator; and determining if said discharge pressure indicates that said discharge pressure is within an allowable range.

27. The method of claim 26, wherein said method further includes the steps if increasing said discharge pressure if said discharge pressure indicator indicates that said discharge pressure is below a predetermined lower limit.

28. The method of claim 27, wherein said increasing step includes the step of closing a condenser pressure control valve.

29. The method of claim 26, wherein said method further includes the step of decreasing said discharge pressure if said discharge pressure indicates that said discharge pressure is above a predetermined upper limit.

30. The method of claim 29, wherein said decreasing step includes the step of opening a condenser pressure control valve.

31. The method of claim 29, wherein said decreasing step includes the step of opening a condenser pressure control valve for a limited time to prevent excessive drops in discharge pressure.

32. A method for controlling pressure in a refrigeration system, said method comprising the steps of:

reading a pressure differential indicator;

reducing said pressure differential by opening a valve of said refrigeration system if said pressure differential indicator indicates that said pressure differential is above a predetermined upper limit, wherein said reducing step includes the step of opening said valve for a limited time to prevent excessive drops in pressure differential.

33. The method of claim 32, wherein said valve is a condenser pressure control valve.

34. The method of claim 32, wherein said valve is a high to low side valve.

35. The method of claim 32, wherein said limited time is about one (1) second.

* * * * *